US006363947B1

(12) United States Patent
Wu

(10) Patent No.: US 6,363,947 B1
(45) Date of Patent: Apr. 2, 2002

(54) COSMETIC CASE

(76) Inventor: Shang-Wu Wu, 3F-4, No. 454, Chun Ping Road, Tainan (TW)

( * ) Notice: Subject to any disclaimer, the term of this patent is extended or adjusted under 35 U.S.C. 154(b) by 0 days.

(21) Appl. No.: 09/527,883

(22) Filed: Mar. 20, 2000

(51) Int. Cl.[7] ..... A45D 33/28; A45D 33/24; A45D 33/22

(52) U.S. Cl. ..... 132/297; 132/294; 132/295

(58) Field of Search ..... 132/297, 294, 132/295, 293, 301

(56) References Cited

U.S. PATENT DOCUMENTS 1,498,475 A * 6/1924 Mosheim ..... 132/297
1,525,665 A * 2/1925 Slover et al. ..... 132/297
1,800,230 A * 4/1931 Rosenthal ..... 132/297
4,744,376 A * 5/1988 Verducci ..... 132/297
5,337,890 A * 8/1994 Lai ..... 206/235
6,073,634 A * 6/2000 Gueret ..... 132/218

* cited by examiner

*Primary Examiner*—John J. Wilson
*Assistant Examiner*—Robyn Kieu Doan
(74) *Attorney, Agent, or Firm*—Pro-Techtor International Services

(57) ABSTRACT

A cosmetic case includes a case body, a cover, a slidable cover, and a drawer. The case body has two recesses in an upper surface, a drawer cavity in a bottom for the drawer to be pushed in and pulled out. The cover is pivotally connected to a front half portion of the case body to swing up and down and have a mirror fixed in an inner surface. The slidable cover is combined on a rear half portion of the case body, sliding in and out to open or close the shallow recess formed in the rear half portion. The drawer is positioned in the drawer cavity, possible to be pulled out or pushed in. Then many kinds of cosmetics can be stored in the recesses, the elongate hole, and the drawer.

6 Claims, 7 Drawing Sheets

COSMETIC CASE

BACKGROUND OF THE INVENTION

This invention relates to a cosmetic case, particularly to one possible to contain a wide variety of cosmetics and having a novelty shape.

A conventional cosmetic case generally has a case body and a cover pivotally connected to the case body to swing open and close, impossible to contain a wide variety of cosmetics.

SUMMARY OF THE INVENTION

This invention has been devised to offer a cosmetic case to contain a wide variety of cosmetics and having a new style.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
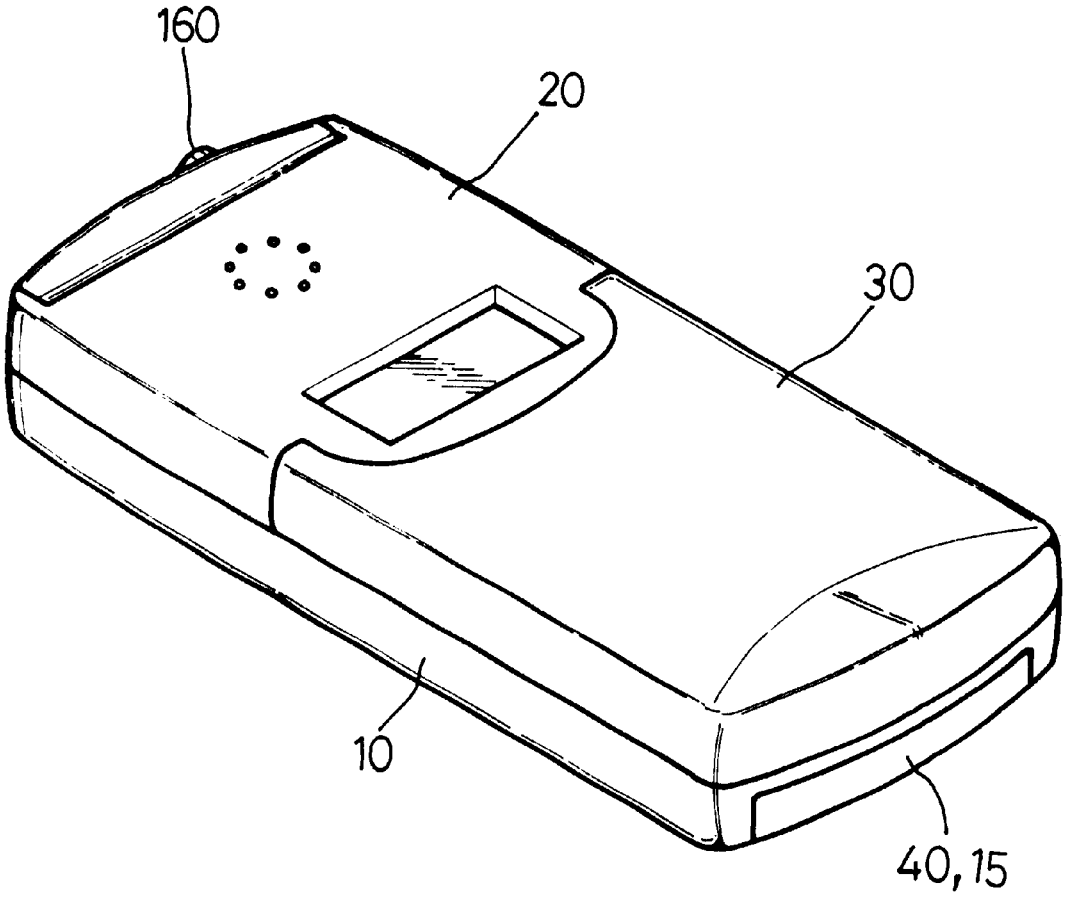
FIG. 1 is a perspective view of a cosmetic case in the present invention.
Figure 2:
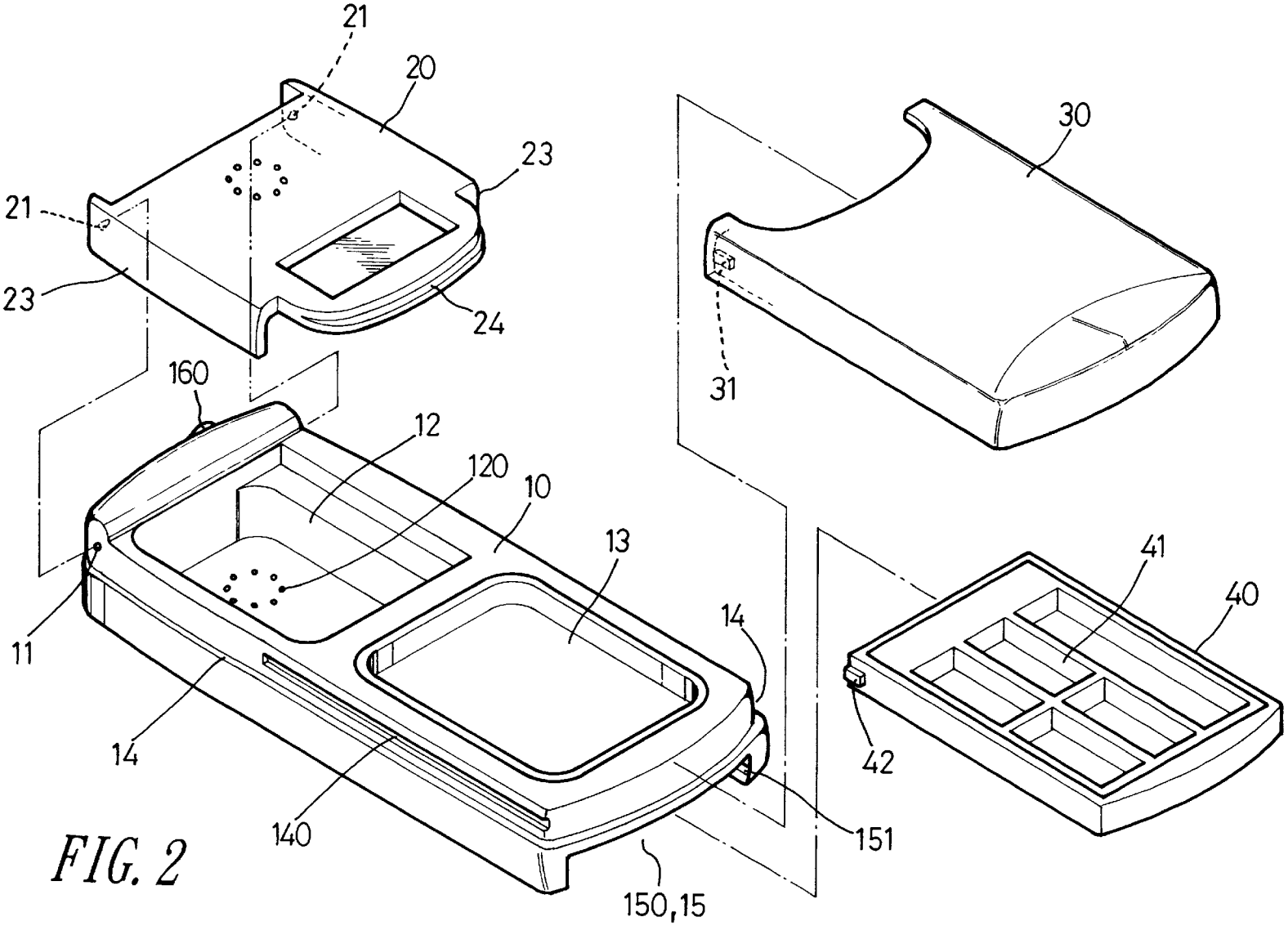
FIG. 2 is an exploded perspective view of the cosmetic case in the present invention.
Figure 3:
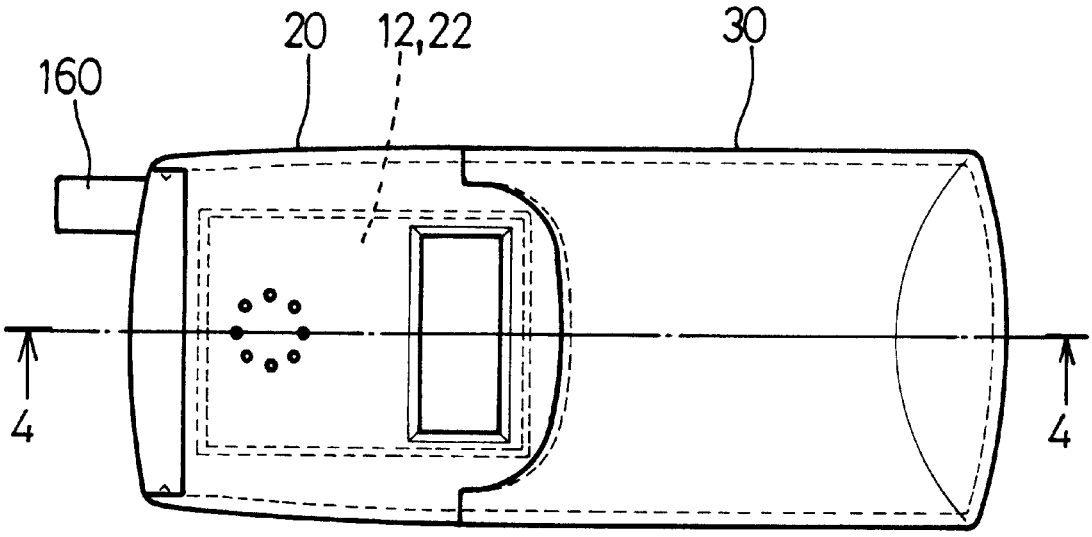
FIG. 3 is an upper view of the cosmetic case in the present invention.

A preferred embodiment of a cosmetic case in the present invention, as shown in FIGS. 1 and 2, includes a case body 10, a cover 20, a slidable cover 30, a drawer 40 as main components combined together.

Figure 6:
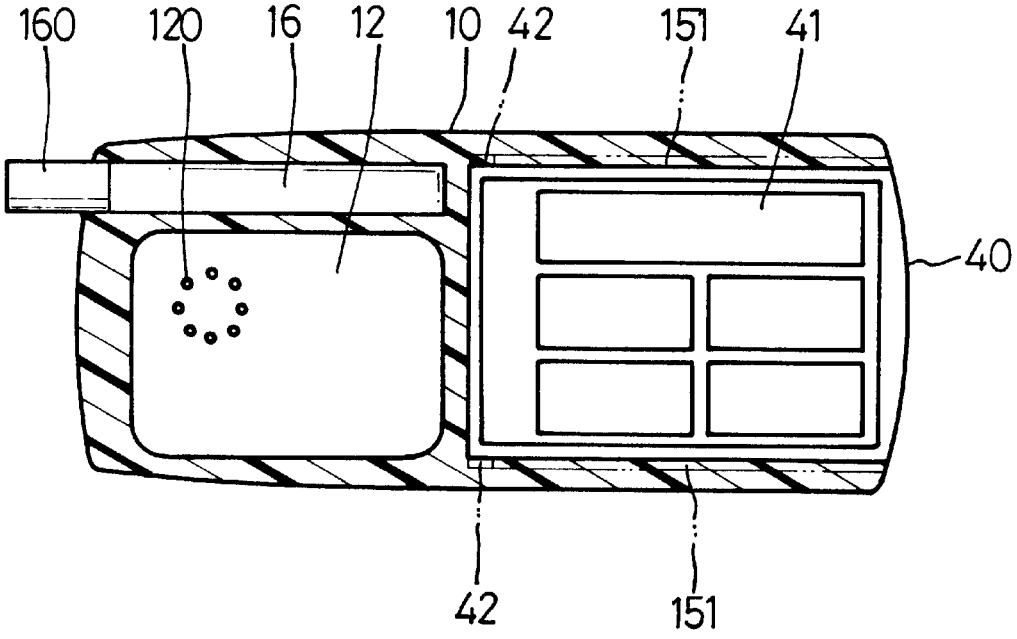
FIG. 6 is a cross-sectional view of the line 6—6 in FIG. 5.
Figure 9:
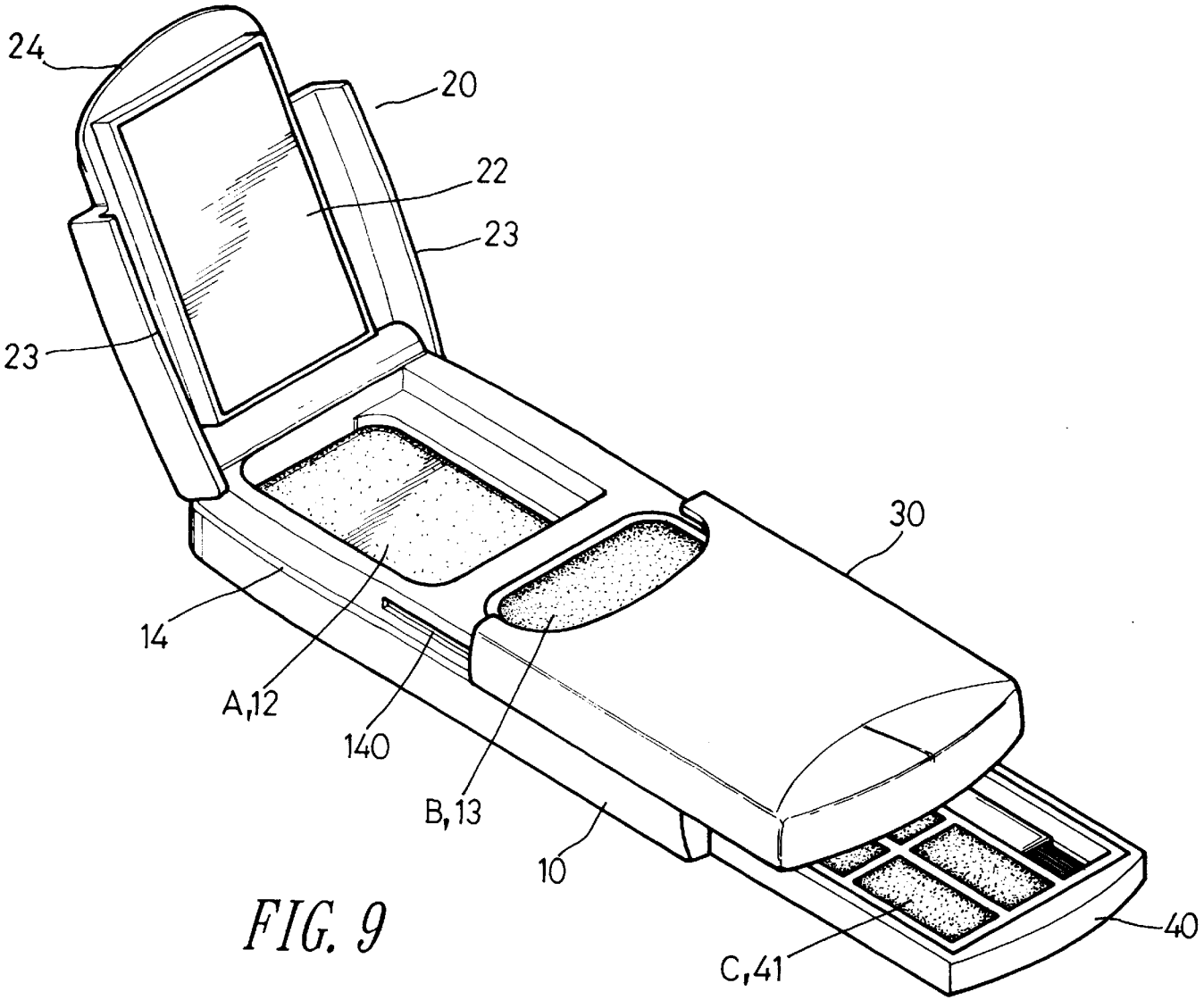

The case body 10 as shown in FIG. 2, has a pivotal hole 11 formed respectively in two sides of a front end, a deep recess 12 and a shallow recess 13 formed separated with an intermediate wall in an upper surface. The deep recess 12 is located near the pivotal hole 11 to place a powder puff A therein, as shown in FIG. 9, having plural air holes 120 in a bottom to communicate with an exterior to keep dry the powder puff A. The shallow recess 13 is to place a pressed powder therein as shown in FIG. 9. The case body 10 further has two lengthwise side walls, which have its upper halves receded inward to form receded walls 14 near the shallow recess 13 having respectively an elongate straight rail groove 140. Further, the case body 10 has a drawer cavity 15 formed in a lower bottom and an aperture 150 formed in a rear end as an entrance of a drawer 40 to slide in, and a guide groove 151 respectively formed in two opposite inner side walls of the cavity 15 as shown in FIGS. 2 and 6. A lengthwise elongate hole 16 is formed in a wall beside the deep recess 12 as shown in FIG. 6, for containing a eyebrow pencil or a small perfume bottle therein, and a cylindrical cap 160 closes the mouth of the hole 16 and functions as a decoration.

Figure 4:
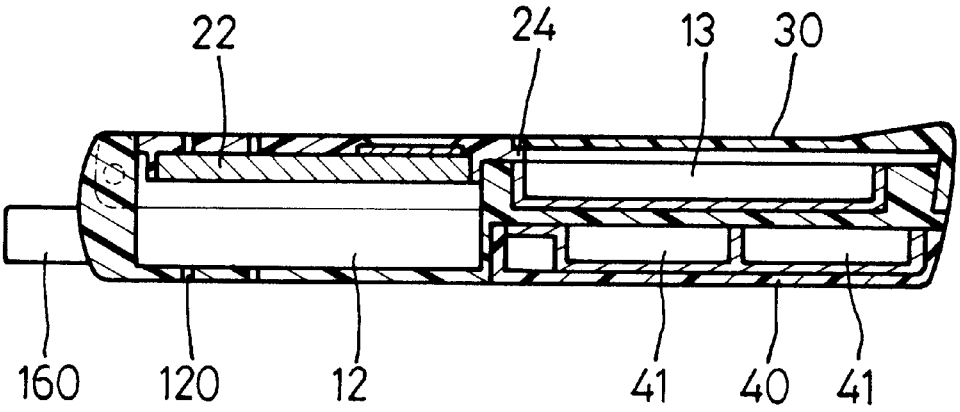
FIG. 4 is a cross-sectional view of the line 4—4 in FIG. 3.
Figure 5:
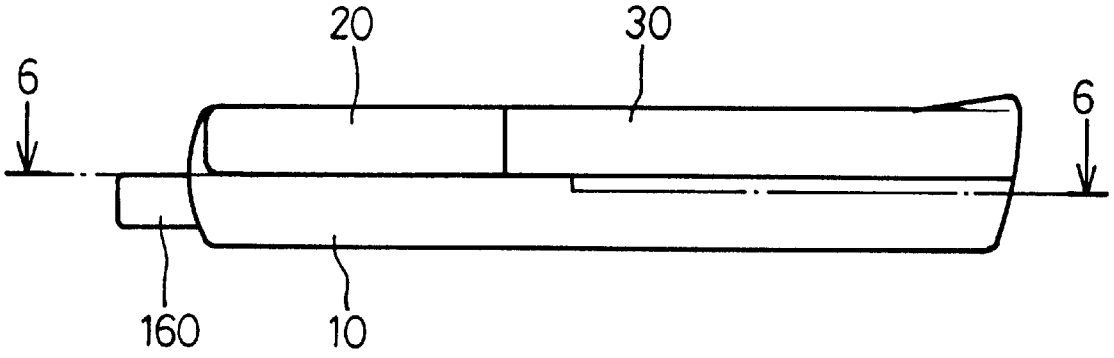
FIG. 5 is a side cross-sectional view of the cosmetic case in the present invention.
Figure 8:
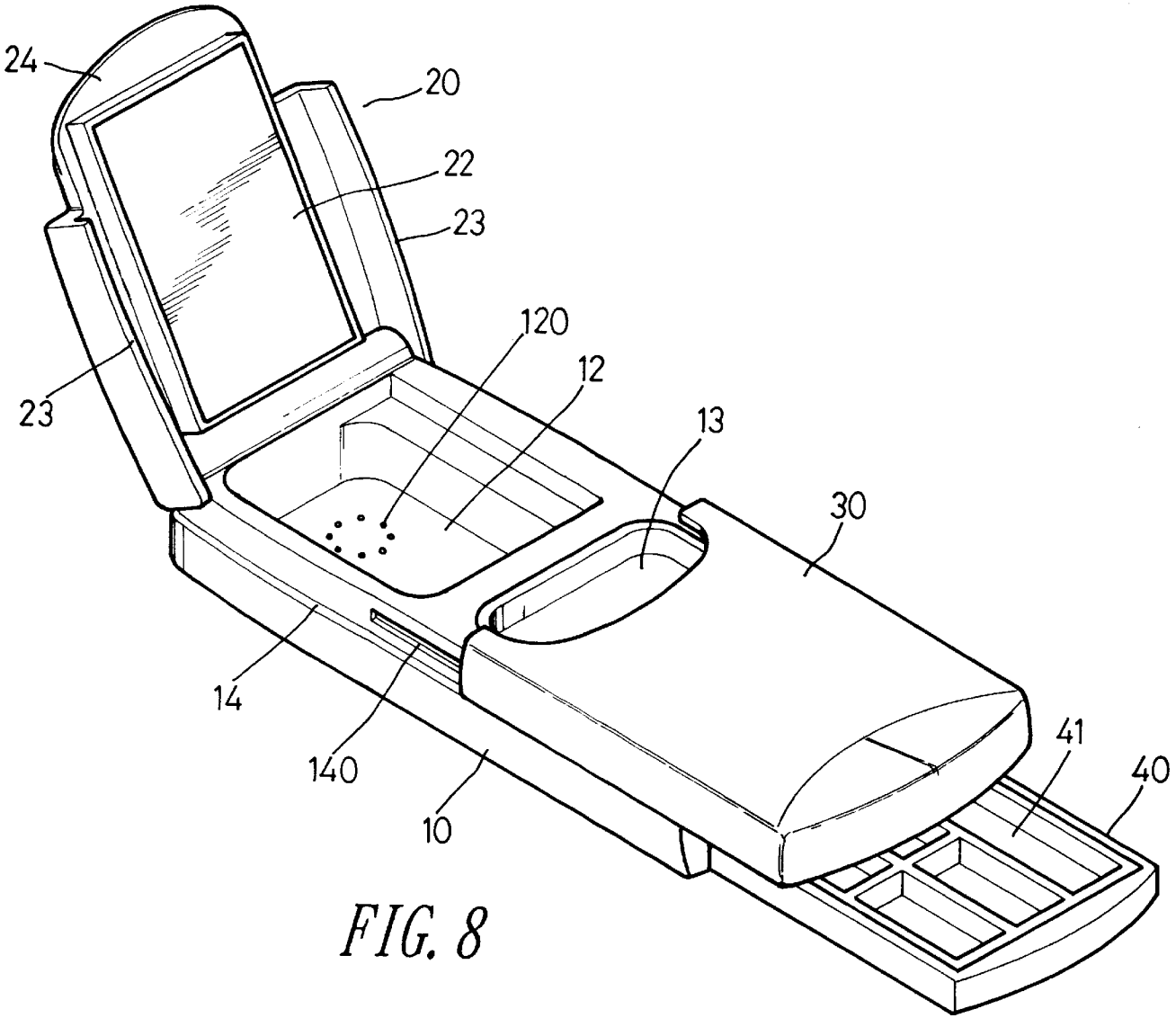
FIG. 8 is a perspective view of the cosmetic case opened up in the present invention; and, FIG. 9 is a perspective view of the cosmetic case filled with cosmetics being opened up in the present invention.

The cover 20, as shown in FIG. 2, has a pivot 21 respectively formed to protrude from two opposite side walls to fit in the pivotal holes 11 of the case body to permit the cover 20 closing on the deep recess 12 swing up and down by means of the two pivots 21. Further, the cover 20 has a mirror 22 fixed on an inner surface, as shown in FIGS. 4 and 8, usable to do makeup. The cover also has two wings 23 extending down from two lengthwise opposite sides to hide the receded walls 14 of the case body 10 when the cover 20 closes up the case body 10, and a rather thin front wing 24 extends forward from a front edge, as shown in FIGS. 2 and 4.

The slidable cover 30, as shown in FIG. 2, is located on the shallow recess 13 of the case body 10, has a protruding tab 31 formed respectively on two inner opposite walls of an inner end to fit in the two rail grooves 140 in the case body 10 to let the slidable cover 30 to slide back and forth along the rail grooves 140. When the slidable cover 30 is correctly fitted on the shallow recess 13, the slidable cover 30 has its inner end fitting with the front wing 24 of the cover 20 and preventing the cover 20 from swinging open.

The drawer 40, as shown in FIG. 2, is positioned in the drawer cavity 15 of the case body 10, having plural chambers 41 divided by separating walls in an upper side for storing various cosmetics and utensils therein (such as lipsticks C and lip pencils as shown in FIG. 9). Further, the drawer 40 has a projection 42 formed respectively at two opposite sides and fitting in the guide grooves 151 to permit the drawer 40 move in and out of the bottom of the case body 10.

In using this cosmetic case after assembled together, the following operations may be done.

Figure 7:
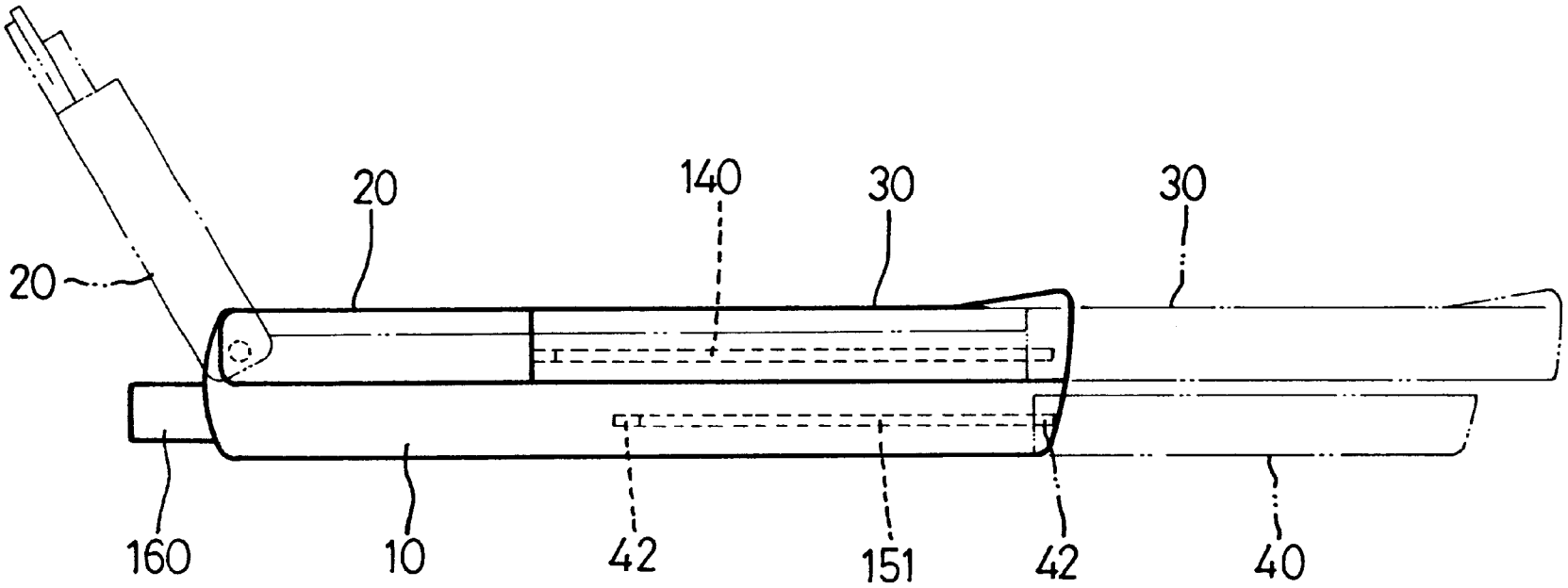
FIG. 7 is a side view of the cosmetic case being in use in the present invention.

1. The slidable cover 30 is pushed out to let the front wing 24 of the cover 20 separated from the slidable cover 30. Then the cover 20 may be swung up as shown in FIG. 7, and the mirror 22 appears in a slanting position for a user to look at to do makeup.

At the same time, the powder puff A (shown in FIG. 9) in the deep recess 12 may be taken out for use.

2. The slidable cover 30 is pulled out, with the projections 31 moving along the rail grooves 140 until the slidable cover 30 completely moves out to expose the pressed powder B, as shown in FIGS. 7–9. Then the pressed powder can be used.
3. The drawer 40 is pulled out of the case body 10 (as shown in FIGS. 7, 8 and 9) to expose the lipsticks C and lip pencils in the drawer 40. When the drawer 40 is completely pulled out, the projections 42 may be stopped by the end walls of the guide grooves 151 of the drawer cavity 15, preventing the drawer from falling out of the case body 10.
4. The cylinder cap 160 is taken off the elongate hole 16, as shown in FIG. 6, for the eyebrow pencil or the perfume bottle to be taken out for use.

As can be understood from the aforesaid description, the cosmetic case in the invention contained almost every kinds of makeup, improving conventional ones to contain only one kind or a few kinds of makeup.

Further, a compressed powder B and lipsticks C may be contained in inner frames and then the inner frames are respectively placed in the shallow recess 13 and the chambers 41 of the drawer 40. In case of the compressed powder or the lipsticks used up, a new one can be replaced, and the cosmetic case still has full usefulness, not reducing its functions.

While the preferred embodiment of the invention has been described above, it will be recognized and understood that various modifications may be made therein and the appended claims are intended to cover all such modifications which may fall within the spirit and scope of the invention.

I claim:

1. A cosmetic case comprising:

a case body having two—one front and the other rear-recesses formed in an upper surface, a rail groove formed respectively in two opposite walls of the rear one of said recesses, a drawer cavity formed in a bottom, said drawer cavity having an aperture in one end of said case body, and a guide groove formed respectively in two opposite inner wall of said drawer cavity;

a cover having one end pivotally connected to said case body, closing on a front deep recess with no rail grooves in its two side walls, and a mirror fixed in an inner surface;

a slidable cover closing on a rear shallow recess with said two rail grooves in its two side walls, a protruding tab respectively formed in two opposite inner walls to fit in said two rail grooves of said case body, said two opposite walls extending down, said slidable cover possible to move back and forth by means of said protruding tabs moving along said rail grooves; and, a drawer movably fitted in said drawer cavity by means of two projections formed on two opposite lengthwise sides fitting and moving along said guide grooves of said case body, said drawer pushed in and pulled out of said drawer cavity in said case body.

2. The cosmetic case as claimed in claim 1, wherein said front deep recess of said case body closed on by said cover has plural air holes in a bottom for air to flow in and out to keep said powder puff always dry.

3. The cosmetic case as claimed in claim 1, wherein said cover has a rather thin front wing formed to extend rearward from a rear end, and said front wing is pressed immovable by an inner end of said slidable cover when said slidable cover is pushed in.

4. The cosmetic case as claimed in claim 1, wherein said case body has a lengthwise elongate hole formed in a side wall of said front deep recess, and a cylindrical cap closes a mouth of said lengthwise elongate hole and protrudes out of said case body for an eyebrow pencil or a small perfume bottle to be contained in said elongate hole.

5. The cosmetic case as claimed in claim 1, wherein said case body has receded surfaces formed in two lengthwise opposite walls of a front half portion to keep an outer surface of said two lengthwise opposite walls flush with said cover when said cover closes on said case body.

6. The cosmetic case as claimed in claim 1, wherein said two recesses and said drawer are for placing various inner frames of cosmetics.

* * * * *